United States Patent [19]

Marston

[11] Patent Number: 4,651,490

[45] Date of Patent: Mar. 24, 1987

[54] FASTENING ASSEMBLY FOR MECHANICALLY ATTACHING A FLEXIBLE MEMBRANE TO A ROOF CONSTRUCTION

[75] Inventor: Caroll E. Marston, Brooklyn, Conn.

[73] Assignee: Syenergy Methods, Inc., Cranston, R.I.

[21] Appl. No.: 837,147

[22] Filed: Mar. 7, 1986

[51] Int. Cl.[4] ..... E04B 5/00

[52] U.S. Cl. ..... 52/410; 52/222; 52/718.1

[58] Field of Search ..... 52/202, 222, 410, 467, 52/506, 716, 717, 718, 741; 160/392, 395

[56] References Cited

U.S. PATENT DOCUMENTS

| | | | |
|---|---|---|---|
| 3,895,468 | 7/1975 | Bernstein | 52/222 |
| 3,984,958 | 10/1976 | Murray | 52/410 X |
| 4,502,256 | 3/1985 | Hahn | 52/506 X |
| 4,532,744 | 8/1985 | Beneze et al. | 52/410 X |
| 4,543,758 | 10/1985 | Lane | 52/718.1 X |
| 4,574,551 | 3/1986 | Giannuzzi | 52/410 X |

FOREIGN PATENT DOCUMENTS 910194 of 1902 United Kingdom ..... 52/202

*Primary Examiner*—William F. Pate, III
*Assistant Examiner*—Creighton Smith
*Attorney, Agent, or Firm*—Salter & Michaelson

[57] ABSTRACT

A fastening assembly for mechanically attaching a waterproof flexible membrane to a roof construction at spaced apart intervals, comprising a post member that is mounted over an insulation member and that receives the flexible membrane in overlying relation thereon, a flexible circular member being forced into overlying relation on said flexible membrane as located over the post member to cause said flexible membrane to encircle said post member in tight fitting relation thereon, wherein the flexible membrane is sandwiched between the post member and the flexible circular member for mechanically fixing the flexible membrane on the roof construction.

5 Claims, 2 Drawing Figures

FASTENING ASSEMBLY FOR MECHANICALLY ATTACHING A FLEXIBLE MEMBRANE TO A ROOF CONSTRUCTION

BACKGROUND OF THE INVENTION

The present invention relates to a fastening assembly for mechanically attaching a flexible membrane to a roof construction. More particularly the present invention relates to a unique fastening assembly that provides for the attachment of a flexible waterproof membrane to a roof construction at spaced locations and that enables an efficient, durable, waterproof roof system to be obtained.

The use of flexible membranes in roof constructions which include a base or deck having insulation material placed thereon and a waterproof flexible membrane fixed over the insulation have heretofore been available in several different applications. One such application is the securement of the waterproof flexible membrane to the underlying insulation material and roof deck by fully adhering the underneath surface of the membrane by a bonding adhesive to the insulation material. However, such a roof system is somewhat expensive to apply because of the labor intensive requirement of the spreading of an adhesive over the entire roof surface and then adhering the flexible membrane thereto.

Another form of roof system employing a waterproof flexible membrane known heretofore is the use of ballasted material therewith wherein small rocks are deposited over the membrane as placed over the insulation material, the small rocks providing sufficient weight for retaining or anchoring the membrane in its position over the insulation material. Here again, certain disadvantages are present in such a system since the ballast material not only is not cost efficient to utilize, but the weight of the ballast material is oftentimes too great for a roof construction to carry, particularly if the roof construction was not originally designed to receive the additional ballasted weight thereon.

A system that was designed to avoid the problems experienced with the fully adhered membrane and the ballasted membrane in a roof construction was the intermittently attached system. Such systems fall into basically two categories, one being the spot-bonded system as represented by U.S. Pats. Nos. 4,162,597 and 4,389,826 to Kelly and the German Pat. No. 23 00 798. The first Kelly patent, U.S. Pat. No. 4,162,597, relies solely on the attachment of the membrane to a plurality of spaced apart pads by a bonding adhesive, the pads being secured to the insulation and deck through a fastener element. The German patent also fixes a plurality of plates in overlying relation on insulation and then adheres a flexible membrane to the plates by an adhesive or by heat sealing. Although both the Kelly and German patents show systems that have been utilized commercially, both such systems rely upon adhesives or heat sealing to attach the flexible membrane to a plurality of spaced apart pads or plates, and on occasion the adhesive or heat seal in these systems will be affected by temperatures and time and will lose their adhesive qualities, thereby resulting in a failure of the roof system. The other U.S. Pat. No. 4,389,826 to Kelly shows an alternative form of spot bonding system, wherein the membrane is secured over insulation and to a deck by a plurality of spaced apart fasteners that extend through plates and the membrane. Such a system is inherently defective, since the overlying cover member will not always seal the fastener that extends through the membrane, and this system has not found favor in the trade.

The second category of systems that have been developed for intermittently attaching a flexible membrane to a roof construction, is illustrated in the German Pat. No. 28 04 962. The roof system as illustrated in this latter German patent provides for the mechanical spot fastening of the membrane to the underlying roof deck, and for this purpose the German patent includes a post that is fixed to the insulation and over which the flexible membrane is placed. An attachment element with flexible tines formed thereon is provided for forcing the membrane over the post to secure the membrane in place. A cover or cap is then placed over the attachment element. Although this latter system initially functioned to mechanically secure the membrane in place, it was found to be inoperable after a period of use, since the attachment element tended to fracture or rupture the membrane, thereby causing the roof system to fail.

Other patents of which applicant is aware and that are of general interest relative to the subject invention are the U.S. Pat. Nos. 3,426,412 to Streng et al,; 3,453,794 to Block, and 4,382,353 and 4,441,295 to Kelly.

As will be described hereinafter, the subject invention avoids the problems as set forth hereinabove and provides for a relatively simple, inexpensive, and effective mechanical fastening assembly by which a waterproof flexible membrane is attached to a roof construction at spaced apart intervals.

SUMMARY OF THE INVENTION

The present invention relates to a fastening assembly for mechanically attaching a waterproof flexible membrane to a roof construction, wherein the roof construction includes a roof deck on which insulation members are supported. A plurality of mechanical fastening assemblies to which the flexible membrane is secured at spaced apart intervals provide for the intermittent attachment of the flexible membrane to the roof construction, each of the fastening assemblies including a plate that is received on an insulation member, a post member located on the plate, and a fastener element projecting through the post member and insulation member and into the deck of the roof construction for securing the post member to the deck. The flexible membrane is placed over the post member, and a flexible circular member is forced into overlying relation on the flexible membrane for each fastening assembly to cause the flexible membrane to encircle the post member in tight fitting relation thereon, wherein the flexible membrane is sandwiched between each of the post members and the flexible circular member mounted thereon for mechanically fixing the flexible membrane on the roof construction at spaced apart intervals.

Accordingly, it is an object of the invention to provide a unique fastening assembly for mechanically attaching a flexible membrane to a roof construction in intermittent relation.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
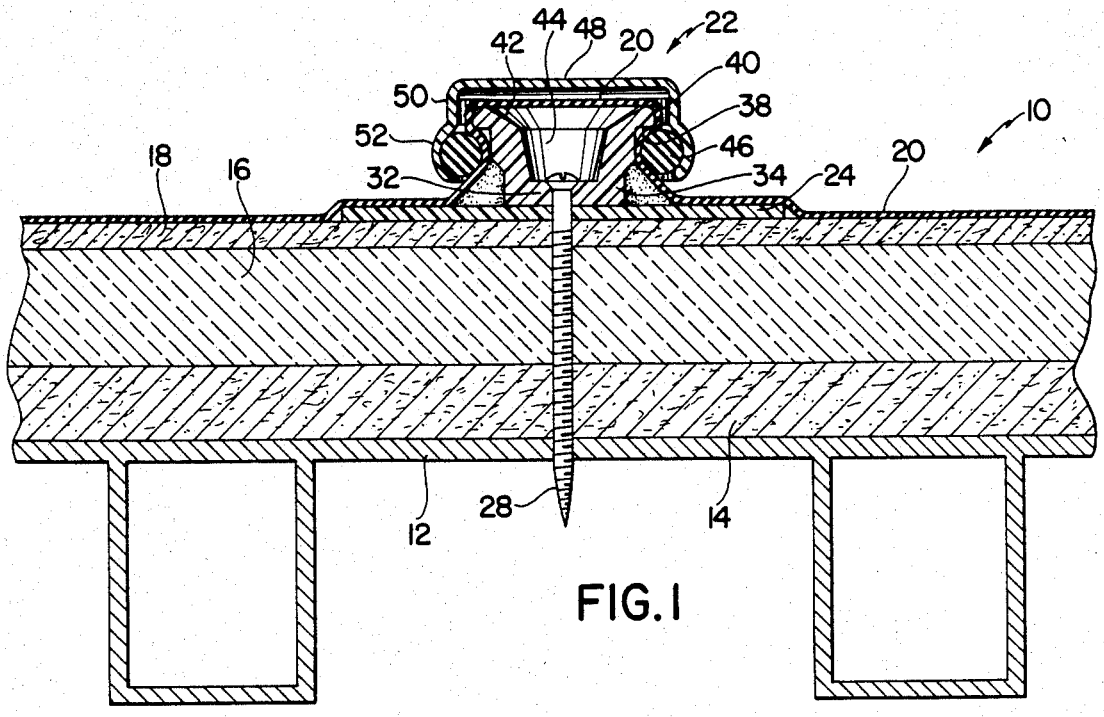
FIG. 1 is a vertical sectional view of a roof construction illustrating the fastening assembly of the subject invention and the manner in which a waterproof flexible membrane is mechanically attached to the roof construction.

Referring now to the drawing and particularly to FIG. 1, a roof construction is illustrated in vertical section and is generally indicated at 10. The roof construction 10 is formed of the usual roofing installation components insofar as the submembers are concerned and includes a roof deck 12 that may be formed of any suitable structural material such as metal, wood, concrete, gypsum, tectum, etc. and that defines the support for the overlying layers of material. The roof construction 10 as illustrated in FIG. 1 includes a previous built-up interior covering or layer 14 which is formed of any suitable material previously incorporated into the roof construction, such materials normally being formed of built-up felt layers and tar or the like. However, it is understood that the interior covering 14 is formed of any suitable waterproof material or other kinds of materials that have heretofore been incorporated into roof installations of prior known roof constructions, and it is also contemplated that the roof construction 10 as newly constructed include any suitable base 12 which will not have an interior covering applied thereto.

In the present invention, it is desirable to not only provide a waterproof covering but to also incorporate an insulated material therein that has an acceptable R factor that will appropriately insulate the interior portion of the building on which the roof construction 10 is located. For this purpose, a plurality of insulating boards, one of which is indicated at 16 in FIG. 1, is placed directly over the previous roof covering 14, or if the roof construction is newly built, then the insuating boards will be received directly over the deck 12. The insulating boards 16 may be formed of any suitable insulating material such as Styrofoam or expanded polystyrene (EPS). The boards 16 are also formed in any desired configuration, but are usually constructed in conventioanl dimensions such as 2 ft.×2 ft.; 2 ft.×4 ft. or 4 ft.×8 ft.

In roof constructions on which waterproof flexible membranes such as embodied in the subject invention are employed, it is necessary to counter the effects of wind up-lift at the roof perimeters and corner sections, and for this purpose the membrane is totally adhered by a bonding adhesive to the roof surface around the perimeter and corner sections thereof. Since Styrofoam or EPS cannot accept an adhesive for bonding the flexible membrane thereto, that is, Styrofoam and EPS will disintegrate upon contact with the bonding adhesive, it is necessary to overlay the Styrofoam or EPS insulation boards with additional insulation members that are compatible with the bonding adhesive, that is, they will accept the bonding adhesive for securement of the membrane thereto. The additional insulation members, one of which is indicated in FIG. 1 at 18, has a lower R factor than Styrofoam or EPS or any other type of known insulation, such as isocyanurate, but does define an additional insulation medium. Fiberboard is one example of such an additional insulating material, although others can also be used as long as they are capable of accepting the bonding adhesive without any deterioration thereof, so that the flexible membrane can be fully bonded thereto around the perimeter and corner sections thereof. In some installations the Stryrofoam or EPS insulation members 16 may not be required if the original roof installation included sufficient insulation materials therein. In this circumstance, the additional insulation members 18 are placed directly over the preexisting insulation members, the roof 14 and the deck assembly 12. The additional insulation members 18 are also constructed in any suitable dimensional forms, and normally are dimensioned similarly to the insulation boards 16.

As discussed hereinabove, the purpose of the invention is to secure a flexible membrane that has waterproofing characteristics to the roof installation. For this purpose a waterproof flexible membrane 20 is provided and is formed in sheets of suitable length and width so as to adequately cover the roof surface on which the installation is mounted. Heretofore, the flexible membrane 20 which can be formed of any suitable sheet material, such as EPDM, rubber or PVC, was either fully adhered by a bonding adhesive to the insulation members 18, fixed in place thereon by ballasted material, such as small rocks, or intermittently attached thereto by strips of material which mechanically fastened the membrane 20 to the insulation members 18, or by spaced apart plates or pads to which the membrane 20 was adhered by a bonding adhesive or by heat sealing. The present invention avoids the problems as experienced in these prior known systems and intermittently attaches the flexible membrane 20 to the insulation members 18 and the underlying roof construction 10 by a mechanical fastening assembly generally indicated at 22.

Figure 2:
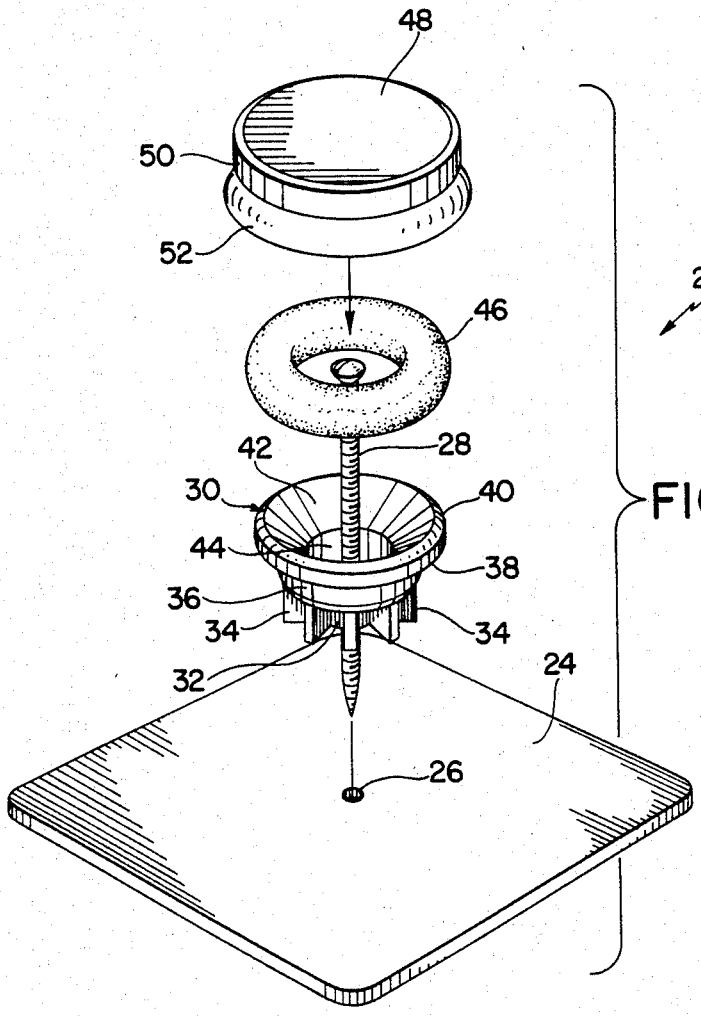
FIG. 2 is an exploded perspective view illustrating the component parts of the fastening assembly as embodied in the subject invention.

Referring now to both FIGS. 1 and 2 of the drawing, the fastening assembly 22 as embodied in the subject invention and that is provided for the purpose of mechanical attaching the flexible membrane 20 to the roof construction 10 at spaced apart intervals, includes a relatively rigid plate 24 that is shown formed in a square configuration and that is preferably formed of a suitable plastic material. Formed centrally of the plate 24 is an opening 26 that receives a fastening screw 28 therein as will hereinafter be described. Mounted on the plate 24 is a post member generally indicated at 30 which is preferably molded in a one-piece construction of any suitable plastic material. As illustrated in FIGS. 1 and 2, the post member 30 includes a base defined by a central portion 32 and a plurality of spaced apart fins 34 that extend outwardly of the central portion 32. Formed integrally with the base member 32 and the fins 34 is an annular central portion 36 that is located directly beneath an annular flange 38. The annular flange 38 has a marginal portion 40, and formed internally of the post member 32 and extending downwardly of the annular flange 38 is a countersunk portion 42 that communicates with an interior recess 44. Extending through the base member 32 at the bottom of the recess 44 is a bore through which the fastening element 28 projects. Although, as illustrated and described, the plate member 24 and the post member 30 are formed as independent and separate elements, it is also contemplated that these elements be formed in a one-piece assembly. As will be further described hereinafter, the fastening assembly 22 also includes a flexible circular member 46 that has a circular cross section and is generally referred to as an "O"-ring. A cap 48 completes the assembly and is formed with a downwardly extending flange 50 that terminates in a curved or outwardly extending rounded flange portion 52.

Prior to the attachment of the waterproof flexible membrane 20 to the roof construction, each of the post members 30 is placed over a plate 24, the plates 24 being located in spaced apart relation and in surface-to-surface contact on the insulation members 18 such that the bore as formed in the bottom of the recess 44 of each post member 30 is aligned with the hole 26 as formed in the plate 24 on which each post member is placed. The post members 30 are fixed in place on the additional insulation members 18 by their respective fastener elements 28 that are inserted into the bore of each post member and through the hole 26 of each plate 24 and then urged downwardly through the insulation members 18, insulation blocks 16, the preexisting built-up roof 14 (if the roof construction is to be retrofitted with a new roof) and into the roof deck 12 for also effectively securing the post members 30 to the roof deck. With the post members 30 fixed in place as described, the flexible membrane 20 is rolled over the post members 30 for location in overlying relation thereon. An O-ring 46 is next mounted on each post member 30 by a special device (not shown), which expands the O-ring 46 and rolls it over the flange 38 of the post member. As the O-ring, which overlies the flexible membrane 20, is rolled over the flange 38, the configuration thereof enables the O-ring to be properly snapped into place around the flexible membrane beneath the flange 38 and onto the central portion 36 of the post member. The membrane 20 is thus tightly and securely fixed at spaced apart intervals over the insulation members 18 by the post members 30 and in effect is secured to the insulation boards 16, insulation members 18 and the roof deck 12. In effect, the membrane 20 is sandwiched between the O-ring 46 and the post member 30 of each fastening unit and is thereby effectively held in place without the use of any adhesive materials. The assembly is then completed by the mounting of the cap 48 over the captured membrane; and as shown in FIG. 1, the cap 48 is snapped around the O-ring 46, the interior surface of the curved flange portion 52 of the cap 48 having a configuration that conforms to the shape of the exterior surface of the O-ring 46. The cap 48 is thereby retained in secure position over the captured membrane.

It is seen that the waterproof flexible membrane 20 is mechanically attached to the roof construction 10 in an intermittent manner, and that it is fixed in place by the relatively simple mounting of the post members 30 onto the insulation members 18 and the securement of the O-ring 46 therearound. Because the O-ring 46 is of a flexible material and is nonmetallic in construction, the flexible membrane 20 will not be subjected to pressure of sharp corners that would tend to tear the membrane as it is urged upwardly by wind up-lift forces that are experienced on windy days. The O-ring 46 absorbs the stresses that are exerted by wind up-lift on the flexible membrane 20 and prevents the deterioration or tearing thereof which was normally experienced by the prior known mechanical fasteners for flexible membranes. The mechanical attachment as described herein also does not depend upon adhesives for the attachment of the membrane 20 to the roof construction, and thus the membrane will tend to wear more consistently in long-term use thereof. In addition, the fastening assembly 22 can be easily removed from engagement with the flexible membrane 20 should the need arise for gaining access to the roof construction beneath the flexible membrane.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A fastening assembly for mechanically attaching a flexible membrane to a roof construction at spaced-apart intervals, wherein said roof construction includes a roof support structure, comprising a post member located over said support structure and having an annular flange formed on the upper end thereof, a fastener element projecting through said post member and into said support structure for securing said post member to said support structure, said flexible membrane extending over said post member, and a flexible O-ring that is expandedly forced over the annular flange of said post member into overlying relation on said flexible membrane, wherein said flexible O-ring is located beneath said annular flange to cause said flexible membrane to envelop said post member in tight fitting relation thereon, said flexible membrane thereby being sandwiched between said post member and said flexible O-ring for mechanically fixing said flexible membrane on said roof construction, and a separately constructed cap having an upper portion and an annular depending skirt portion joined to said upper portion, said cap being assembled on said post member by locating said skirt portion in surrounding and engaging relation on said O-ring to positively retain the O-ring in overlying relation on said flexible membrane, wherein the flexible membrane is positively and mechanically attached to said post member in a manner so as to prevent disengagement of said flexible membrane from said post member even when forces are exerted on said flexible membrane by wind up-lift.

2. A fastening assembly as claimed in claim 1, said post member further including an annular central portion that is located beneath said annular flange and that has a diameter less than that of said annular flange, said O-ring being received in overlying relation with respect to said annular central portion when it is expandedly forced over said annular flange.

3. A fastening assembly as claimed in claim 1, a central recess formed in said post member at the bottom of which a bore is formed that extends through the bottom of said post member, said fastener element extending through said bore for entry into said roof support structure, said fastener element having a head formed thereon that is captured in said recess in said post member to secure said fastener element therein.

4. A fastening assembly as claimed in claim 1, a plate mounted on said support structure and having said post member joined thereto, said fastening element extending through said plate for fixing said post member and said plate to said support structure.

5. A fastening assembly as claimed in claim 1, said annular depending skirt portion of said cap being formed with an annular internal concave surface, the configuration of which generally conforms to the surface of said O-ring, wherein said skirt portion is located in overlying surface-to-surface engaging relation with said O-ring in the assembled position of said cap on said post member.

* * * * *